US011694623B2

(12) United States Patent
Pyun et al.

(10) Patent No.: US 11,694,623 B2
(45) Date of Patent: Jul. 4, 2023

(54) DISPLAY DEVICE AND METHOD FOR DRIVING THE SAME

(71) Applicant: Samsung Display Co., Ltd., Yongin-Si (KR)

(72) Inventors: Ki Hyun Pyun, Gwangmyeong-si (KR); Hee Sook Park, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/403,856

(22) Filed: Aug. 16, 2021

(65) Prior Publication Data

US 2022/0076630 A1 Mar. 10, 2022

(30) Foreign Application Priority Data

Sep. 10, 2020 (KR) ..... 10-2020-0116274

(51) Int. Cl.

| | |
|---|---|
| ***G09G 3/3258*** | (2016.01) |
| ***G09G 3/00*** | (2006.01) |
| ***G09G 3/3266*** | (2016.01) |
| ***G09G 3/3291*** | (2016.01) |

(52) U.S. Cl.

CPC ..... *G09G 3/3258* (2013.01); *G09G 3/006* (2013.01); *G09G 3/3266* (2013.01); *G09G 3/3291* (2013.01); *G09G 2310/061* (2013.01); *G09G 2320/045* (2013.01); *G09G 2320/048* (2013.01)

(58) Field of Classification Search

CPC ..... G09G 3/3233; G09G 3/3208; G09G 2320/043; G09G 2320/045; G09G 2320/0233; G09G 2320/048; G09G 2320/0295; G09G 2320/029; G09G 3/006; G09G 3/3291; G09G 3/20; G09G 2320/0693; G09G 2320/0242; G09G 2360/145; G09G 2330/10

See application file for complete search history.

(56) References Cited

U.S. PATENT DOCUMENTS

| | | | | |
|---|---|---|---|---|
| 2016/0019839 | A1* | 1/2016 | In | G09G 3/3258 345/212 |
| 2016/0133175 | A1* | 5/2016 | Lee | G09G 3/3208 345/694 |
| 2017/0213493 | A1* | 7/2017 | Han | G09G 3/3208 |
| 2018/0061295 | A1* | 3/2018 | Hong | G09G 3/3266 |
| 2020/0082759 | A1* | 3/2020 | Lee | G09G 3/3233 |
| 2021/0390911 | A1* | 12/2021 | Kim | G09G 3/3291 |
| 2022/0036834 | A1* | 2/2022 | Han | H01L 27/3262 |

FOREIGN PATENT DOCUMENTS

| | | | |
|---|---|---|---|
| KR | 10-2017-0080935 | A | 7/2017 |
| KR | 10-2017-0081053 | A | 7/2017 |
| KR | 10-2017-0088452 | A | 8/2017 |
| KR | 10-1964458 | B1 | 4/2019 |
| KR | 10-2020-0052510 | A | 5/2020 |
| KR | 10-2020-0076346 | A | 6/2020 |

* cited by examiner

*Primary Examiner* — Dong Hui Liang
(74) *Attorney, Agent, or Firm* — Innovation Counsel LLP

(57) ABSTRACT

A display device may include a display unit, a signal controller, and a sensing unit. The display unit may include pixels. The signal controller may select a first pixel set from the pixel according to ages of the pixels determined based on an image signal. The sensing unit may be electrically connected to each of the display unit and the signal controller and may sense deterioration information of one or more pixels included in the first pixel set for a vertical blank period in which the display unit displays no image.

21 Claims, 10 Drawing Sheets

DISPLAY DEVICE AND METHOD FOR DRIVING THE SAME

CROSS-REFERENCE TO RELATED APPLICATION

This application claims priority to and the benefit of Korean Patent Application No. 10-2020-0116274 filed in the Korean Intellectual Property Office on Sep. 10, 2020; the Korean Patent Application is incorporated by reference.

BACKGROUND

1. Field

The technical field relates to a display device and a driving method of the display device.

2. Description of the Related Art

A display device may include pixels for displaying images. The display device may be an organic light emitting display device, and each of the pixels may include an organic light emitting diode and a driving transistor for supplying a current to the organic light emitting diode. Use of the display device may degrade the organic light emitting diode and driving transistor in a pixel, resulting in degradation of the pixel. Degradation of pixels of the display device may cause deterioration of display quality of the display device. The above information disclosed in this Background section is for enhancement of understanding of the background of the described technology. The Background section may contain information that does not form the prior art that is already known in this country to a person of ordinary skill in the art.

SUMMARY

Embodiments may enable timely sensing and adjustment of a pixel.

Embodiments may display images with uniform luminance regardless of degradation of an organic light emitting diode and/or a driving transistor.

An embodiment may be related to a display device that includes the following elements: a display unit including a plurality of pixels; a sensing unit for sensing degradation information of the pixels for a vertical blank period in which the image signal is not displayed; and a signal controller for determining pixels for the sensing unit to sense degradation information according to ages of the pixels calculated based on an input image signal.

The pixels may be divided into a plurality of block units, and the signal controller may determine to sense degradation information of pixels included in a first block when an average age of the pixels included in the first block among the blocks is greater than a predetermined reference value.

The average age and the predetermined reference value may increase according to a number of image frames displayed on the display unit.

The average age may increase according to a number of image frames displayed on the display unit according to the image signal, and the predetermined reference value may be constant while the number of image frames increases.

When the sensing unit senses degradation information of pixels included in the first block, the signal controller may reset an average age of the pixels included in the first block, of which the degradation information is sensed.

When an average age of the pixels included in the first block among the blocks is equal to or less than a predetermined reference value, the signal controller may determine to sequentially sense degradation information of the pixels.

The pixels may respectively include: an organic light emitting diode; a first transistor connected to an anode of the organic light emitting diode; and a storage capacitor connected to a gate of the first transistor, and the degradation information is a threshold voltage of the first transistor.

The pixels may respectively further include a second transistor connected to the anode and sinking a current flowing from the first transistor to the sensing unit, and the sensing unit may sense the current sinking from the second transistor as degradation information of the pixel including the second transistor.

The sensing unit may sense the degradation information within a vertical blank period in which the pixels do not emit light in one image frame period according to the image signal.

The display device may further include a data driver for receiving an image data signal from the signal controller and applying a data voltage to the pixels, wherein the signal controller may determine a gray compensation value according to the degradation information and the image signal, and may apply the gray compensation value to the image signal to generate the image data signal.

The signal controller may determine to sense degradation information of the first pixel when an age of a first pixel among the pixels is greater than a predetermined reference value.

An embodiment may be related to a method for driving a display device. The method may include the following steps: receiving an image signal; calculating an age of a plurality of pixels included in a display unit based on the image signal; determining pixels for sensing degradation information among the pixels according to ages of the pixels; and sensing degradation information of the determined pixels.

When the pixels are divided into a plurality of block units, the determining of pixels for sensing degradation information includes comparing an average age of the pixels included in the respective blocks with a predetermined reference value, and determining to sense degradation information of pixels included in a first block among the blocks when an average age of pixels included in the first block exceeds the predetermined reference value.

The average age and the predetermined reference value may increase according to a number of image frames displayed on the display unit.

The average age may increase according to a number of image frames displayed on the display unit according to the image signal, and the predetermined reference value may be constant while the number of image frames increases.

The method may further include, when degradation information of pixels included in the first block is sensed, resetting an average age of pixels included in the first block, of which the degradation information is sensed.

The determining of pixels for sensing degradation information may further include, when an average age of pixels included in a first block among the blocks is equal to or less than a predetermined reference value, determining to sequentially sense degradation information of the pixels.

The pixels may each include an organic light emitting diode, a first transistor connected to an anode of the organic light emitting diode, and a storage capacitor connected to a gate of the first transistor, and the degradation information may be a threshold voltage of the first transistor.

The sensing of degradation information of determined pixels may be performed within the vertical blank period in which the pixels do not emit light for one image frame period according to the image signal.

An embodiment may be related to a display device that includes the following elements: a scan driver for transmitting a plurality of scan signals to a plurality of scan lines; a gate driver for transmitting a plurality of gate signals to a plurality of gate lines; a data driver for transmitting a plurality of data signals to a plurality of data lines; a sensing unit for sinking a current from a plurality of lead out lines; a display unit including a plurality of pixels connected to a corresponding scan line among the scan lines, a corresponding gate line among the gate lines, a corresponding data line among the data lines, and a corresponding lead out line among the lead out lines, and displaying an image when the pixels respectively emit light according to the corresponding data signals; and a signal controller for controlling the scan driver, the gate driver, the data driver, and the sensing unit so as to sense the degradation information within a vertical blank period in which the pixels do not emit light for one image frame period according to the input image signal, wherein a scan line for applying a scan signal for a vertical blank period of a first image frame may be separated from a scan line for applying a scan signal for a vertical blank period of a second image frame that is continuous to the first image frame with at least one intervening scan line.

A gate line for applying a gate signal for a vertical blank period of the first image frame may be separated from a gate line for applying a gate signal for a vertical blank period of the second image frame with at least one intervening gate line.

The pixels may respectively include: an organic light emitting diode; a first transistor connected to an anode of the organic light emitting diode and transmitting a driving current; a storage capacitor connected to a gate of the first transistor; a second transistor connected to the gate line and the scan line and transmitting a data voltage corresponding to the data signal to the storage capacitor; and a third transistor connected between the lead out line and the anode, and including a gate connected to the gate line.

The degradation information may be threshold voltage and electron mobility information of the first transistor.

The second transistor may be turned on by the scan signal, and may transmit a sensing reference voltage transmitted to the data line to the storage capacitor for a vertical blank period of the first image frame.

The third transistor may be turned on by the gate signal, and may sink a current generated by the first transistor to the sensing unit according to the sensing reference voltage.

An embodiment may be related to a display device. The display device may include a display unit, a signal controller, and a sensing unit. The display unit may include pixels. The signal controller may select a first pixel set from the pixels according to ages of the pixels determined based on an image signal. The sensing unit may be electrically connected to each of the display unit and the signal controller and may sense deterioration information of one or more pixels included in the first pixel set for a vertical blank period in which the display unit displays no image.

The pixels may be divided into pixel groups.

The signal controller may select the first pixel set as a first pixel group when an average age of the pixels included in the first pixel group is greater than a reference value.

Each of the average age and the reference value may increase according to a total number of image frames that have been displayed by the display unit.

The average age may increase according to a total number of image frames that have been displayed by the display unit. The reference value may be constant when the average age increases.

When the sensing unit senses deterioration information of the pixels included in the first pixel group, the signal controller may reset the average age of the pixels included in the first pixel group.

When the average age of the pixels included in the first pixel group is equal to or less than the reference value, the signal controller may control the sensing unit to sequentially sense deterioration information of the pixels of the display unit.

Each the pixels included in the first pixel group may include an organic light emitting diode, a first transistor electrically connected to an anode of the organic light emitting diode, and a storage capacitor electrically connected to a gate of the first transistor. The deterioration information includes a threshold voltage of the first transistor.

Each of the pixels included in the first pixel group may include a second transistor electrically connected to the anode and transmitting a current flowing from the first transistor to the sensing unit. The sensing unit may sense the current as part of the deterioration information.

The sensing unit may sense the deterioration information within the vertical blank period in which the first pixel set emits no light in one image frame period according to the image signal.

The display device may include a data driver electrically connected to the signal controller for receiving an image data signal from the signal controller and applying a data voltage to the pixels. The signal controller may determine a grayscale compensation value according to the deterioration information and the image signal. The signal controller may apply the grayscale compensation value to the image signal to generate the image data signal.

The signal controller may control the sensing unit to sense deterioration information of a first pixel among the pixels of the display unit when an age of the first pixel is greater than a reference value.

An embodiment may be related to a method for driving a display device. The display device may include a display unit. The method may include the following steps: receiving an image signal; determining ages of pixels included in the display unit based on the image signal; selecting, using a signal controller, a first pixel set from the pixels according to the ages of the pixels included in the display unit; and sensing, using a sensing unit that may be electrically connected to the display unit, deterioration information of one or more pixels included in the first pixel set.

The method may include dividing the pixels into pixel groups.

The method may include comparing an average age of the pixels included in each of the pixel groups with a reference value. The method may include selecting, using the signal controller, the first pixel set as a first pixel group when the average age of the pixels included in the first pixel group exceeds the reference value.

The average age of the pixels included in each of the pixel groups and the reference value may increase according to a total number of image frames that have been displayed by the display unit.

The average age of the pixels included in each of the pixel groups may increase according to a total number of image frames that have been displayed by the display unit. The reference value may be constant when the total number of image frames increases.

The method may include the following step: when the deterioration information of the pixels included in the first pixel group is sensed, resetting the average age of the pixels included in the first pixel group.

The method may include the following step: when the average age of the pixels included in a first pixel group is equal to or less than the reference value, controlling the sensing unit to sequentially sense deterioration information of the pixels included in the display unit.

Each of the pixels included in the first pixel group may include an organic light emitting diode, a first transistor electrically connected to an anode of the organic light emitting diode, and a storage capacitor electrically connected to a gate of the first transistor. The deterioration information may include a threshold voltage of the first transistor.

The method may include dividing the pixels into pixel groups. The method may include selecting, using the signal controller, the first pixel set as a first pixel group. The sensing of the deterioration information of the pixels included in the first pixel group may be performed within a vertical blank period in which the pixels included in the first pixel group emit no light according to the image signal.

An embodiment may be related to a display device that includes the following elements: a scan driver for transmitting scan signals to scan lines; a gate driver for transmitting gate signals to gate lines; a data driver for transmitting data signals to data lines; lead lines; a sensing unit for receiving currents from the lead lines; a display unit including pixels electrically connected to the scan lines, the gate lines, the data lines, and the lead lines; and a signal controller for controlling at least one of the scan driver, the gate driver, the data driver, and the sensing unit to sense deterioration information of one or more of the pixels. A first scan line among the scan lines may apply a scan signal for a vertical blank period of a first image frame. A second scan line among the scan lines may apply a scan signal for a vertical blank period of a second image frame. The second image frame may immediately follow the first image frame. At least one intervening scan line among the scan lines may be positioned between the first scan line and the second scan line.

A first gate line may apply a gate signal for the vertical blank period of the first image frame. A second gate line may apply a gate signal for the vertical blank period of the second image frame. At least one intervening gate line may be positioned between the first gate line and the second gate line.

Each of the pixels may include the following elements: an organic light emitting diode; a first transistor electrically connected to an anode of the organic light emitting diode and transmitting a driving current; a storage capacitor electrically connected to a gate of the first transistor; a second transistor electrically connected to a gate line and a scan line and transmitting a data voltage corresponding to a data signal to the storage capacitor; and a third transistor electrically connected between a lead line and the anode and including a gate electrically connected to the gate line.

The deterioration information may include threshold voltage and electron mobility information of the first transistor or first transistors of the one or more of the pixels.

The second transistor may be turned on by a scan signal and may transmit a sensing reference voltage received from a data line to the storage capacitor for a vertical blank period of a first image frame.

The third transistor may be turned on by a gate signal and may transmit a current received from the first transistor to the sensing unit according to a sensing reference voltage.

According to embodiments, significant screen distortion is prevented.

According to embodiments, power consumption for sensing pixels is minimized.

According to embodiments, display quality of a display device may be satisfactory.

DETAILED DESCRIPTION

Figure 1:
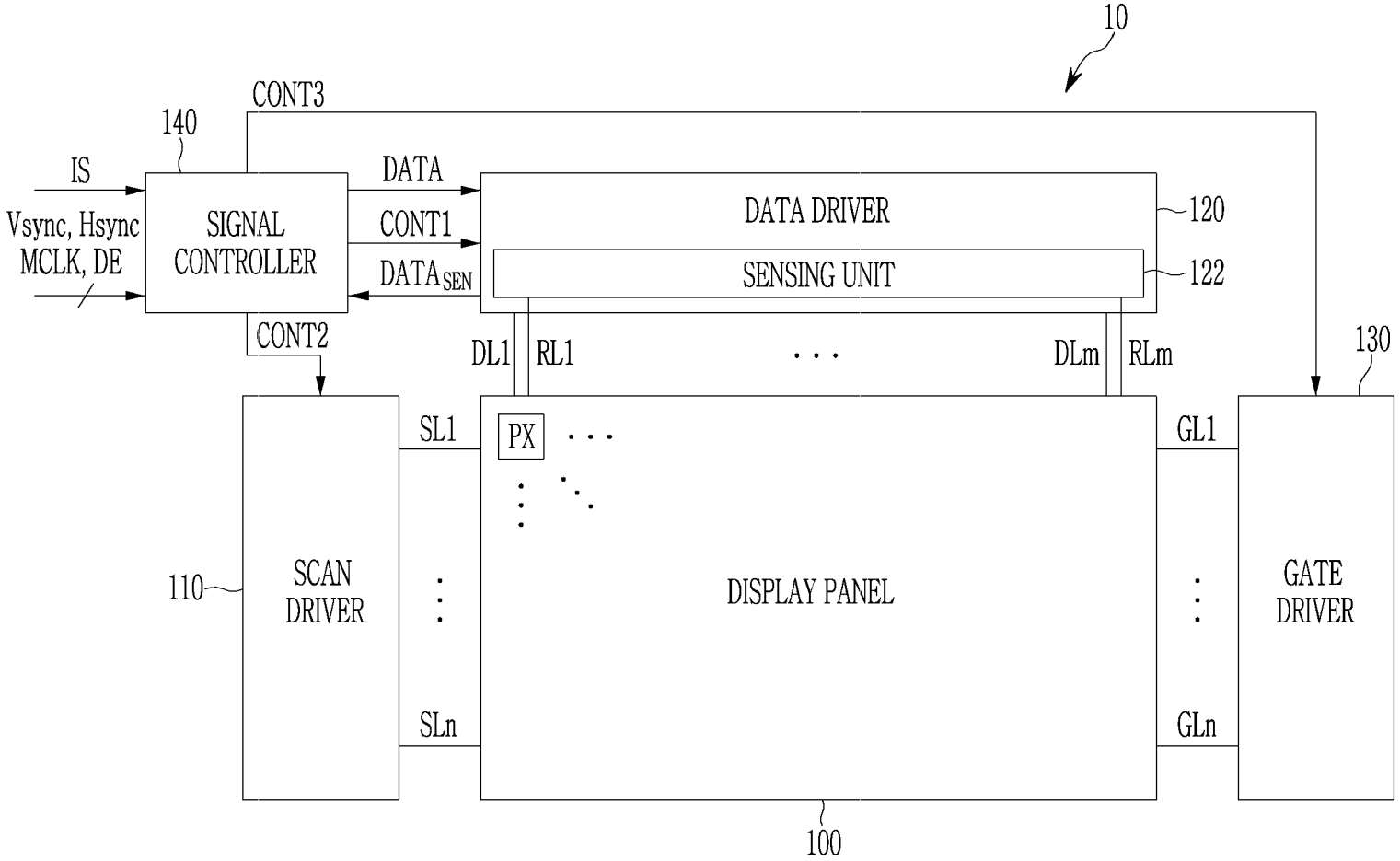
FIG. 1 shows a block diagram of a display device according to an embodiment.

Example embodiments are described with reference to the accompanying drawings. The same or similar components may be denoted by the same or similar reference numerals. The described embodiments may be modified in various ways.

Unless explicitly described to the contrary, the word "comprise" and variations such as "comprises" or "comprising" may indicate the inclusion of stated elements but not the exclusion of any other elements.

Although the terms "first," "second," etc. may be used to describe various elements, these elements should not be limited by these terms. These terms may be used to distinguish one element from another element. A first element may be termed a second element without departing from teachings of one or more embodiments. The description of an element as a "first" element may not require or imply the presence of a second element or other elements. The terms "first," "second," etc. may be used to differentiate different categories or sets of elements. For conciseness, the terms "first," "second," etc. may represent "first-category (or first-set)," "second-category (or second-set)," etc., respectively.

The term "connect" may mean "electrically connect" or "electrically connected through no intervening transistor." The term "insulate" may mean "electrically insulate" or "electrically isolate." The term "conductive" may mean "electrically conductive." The term "drive" may mean "operate" or "control." The term "be degraded" may mean "deteriorate." The term "degradation" may mean "deterioration." The term "degradation information" may mean "degradation/deterioration" or "extent of degradation/deterioration." The term "compensation" may mean "adjustment." The term "compensate" may mean "adjust." The term "gray" may mean "grayscale." The term "age" may mean "length of time in operation/use" or "operation time length." The term "block" may mean "group" or "pixel group." The term "number" may mean "quantity." The term "sense" may mean "measure" and/or "determine." A pixel set may include one or more pixels. A listing of materials may mean at least one of the listed materials.

FIG. 1 shows a block diagram of a display device 10 according to an embodiment. The display device 10 includes a display unit 100, a scan driver (SCAN DRIVER) 110, a data driver (DATA DRIVER) 120, a gate driver (GATE DRIVER) 130, and a signal controller (SIGNAL CONTROLLER) 140.

The display unit 100 includes pixels PX connected to corresponding scan lines among scan lines (SL1 to SLn), corresponding data lines among data lines (DL1 to DLm), and corresponding gate lines among gate lines (GL1 to GLn). Pixels PX respectively emit light according to data signals transmitted through the corresponding data lines, so the display unit 100 may display images.

The scan lines (SL1 to SLn) substantially extend in a row direction and are substantially parallel to each other. The gate lines (GL1 to GLn) substantially extend in a row direction and are substantially parallel to each other. The data lines (DL1 to DLm) substantially extend in a column direction and are substantially parallel to each other.

The scan lines (SL1 to SLn) and the gate lines (GL1 to GLn) may be positioned directly on a same insulating layer. The scan lines (SL1 to SLn), the gate lines (GL1 to GLn), and the data line (DL1 to DLm) may include (or formed of) a same material or different materials, and may be positioned directly on a same insulating layer or different insulating layers.

The scan driver 110 is connected to the display unit 100 through the scan lines (SL1 to SLn). The scan driver 110 generates scan signals according to a control signal CONT2 and transmits them to corresponding scan lines among the scan lines (SL1 to SLn). The control signal CONT2 is generated and transmitted by the signal controller 140.

The data driver 120 is connected to the pixels PX of the display unit 100 through the data lines (DL1 to DLm). The data driver 120 receives an image data signal (DATA) and transmits a corresponding data signal to the corresponding data line among the data lines (DL1 to DLm) according to the control signal CONT1. The control signal CONT1 is generated and transmitted by the signal controller 140.

The data driver 120 selects a gray voltage for transmitting a corresponding data signal to a data line according to the image data signal (DATA). For example, the data driver 120 samples and holds the image data signal (DATA) input according to the control signal CONT1, and transmits data signals to the data lines (DL1 to DLm). The data driver 120 may apply a data signal within a predetermined voltage range to a data line when a low-level scan signal is applied.

The data driver 120 may include a sensing unit 122 for sensing degradation information of pixels PX.

The sensing unit 122 may sense degradation information of the organic light emitting diodes included in pixels PX. The sensing unit 122 may sense threshold voltage and/or electron mobility information of the driving transistors included in pixels PX. The sensing unit 122 transmits degradation information, threshold voltage information, and/or electron mobility information as sensing data ($DATA_{SEN}$) to the signal controller 140.

The sensing unit 122 may be an internal configuration of the data driver 120 or may be separate from the data driver 120.

The scan driver 110 is connected to the display unit 100 through the scan lines (SL1 to SLn). The scan driver 110 generates scan signals according to the control signal CONT2 and transmits them to the corresponding scan lines among the scan lines (SL1 to SLn). The control signal CONT2 is generated and transmitted by the signal controller 140.

The gate driver 130 is connected to the display unit 100 through the gate lines (GL1 to GLn). The gate driver 130 generates gate signals according to the control signal CONT3 and transmits them to the corresponding gate lines among the gate lines (GL1 to GLn). The control signal CONT3 is generated and transmitted by the signal controller 140.

The signal controller 140 receives an image signal (IS) input (from an external source) and input control signals for controlling displaying associated with the image signal (IS). The image signal (IS) may include luminance information related to grayscales of the pixels PX of the display unit 100.

The input control signals may include a data vertical synchronization signal Vsync, a horizontal synchronizing signal Hsync, a main clock signal MCLK, and a data enable signal DE.

The signal controller 140 generates control signals (CONT1, CONT2, CONT3, and CONT4) and an image data signal (DATA) according to the image signal (IS), the horizontal synchronizing signal Hsync, the vertical synchronization signal Vsync, the main clock signal MCLK, and the data enable signal DE.

The signal controller 140 generates a control signal CONT1 for controlling an operation of the data driver 120 and transmits the control signal CONT1 together with the processed image data signal (DATA) to the data driver 120. The signal controller 140 transmits the control signal CONT2 to the scan driver 110. The signal controller 140 may transmit the gate signal CONT3 to the gate driver 130 and may drive the gate driver 130 so as to sense degradation of pixels PX.

The signal controller 140 processes the image signal (IS) according to operational conditions of the display unit 100 and the data driver 120 based on the input image signal (IS) and the input control signals. The signal controller 140 may generate an image data signal (DATA) by applying image processing such as gamma correction or luminance compensation to the image signal (IS). The signal controller 140 may generate the image data signal (DATA) by correcting the image signal (IS) based on the sensing data ($DATA_{SEN}$). The signal controller 140 may correct the image signal (IS) according to degradation information of an organic light emitting diode, threshold voltage deviation of the associated driving transistor, and/or electron mobility deviation of the associated driving transistor. The display device 10 may prevent generation/emission of light with low luminance if the organic light emitting diode (OLED) is significantly degraded, and may display an image with uniform luminance irrespective of the threshold voltage and/or electron mobility deviation of the driving transistor.

Figure 2:
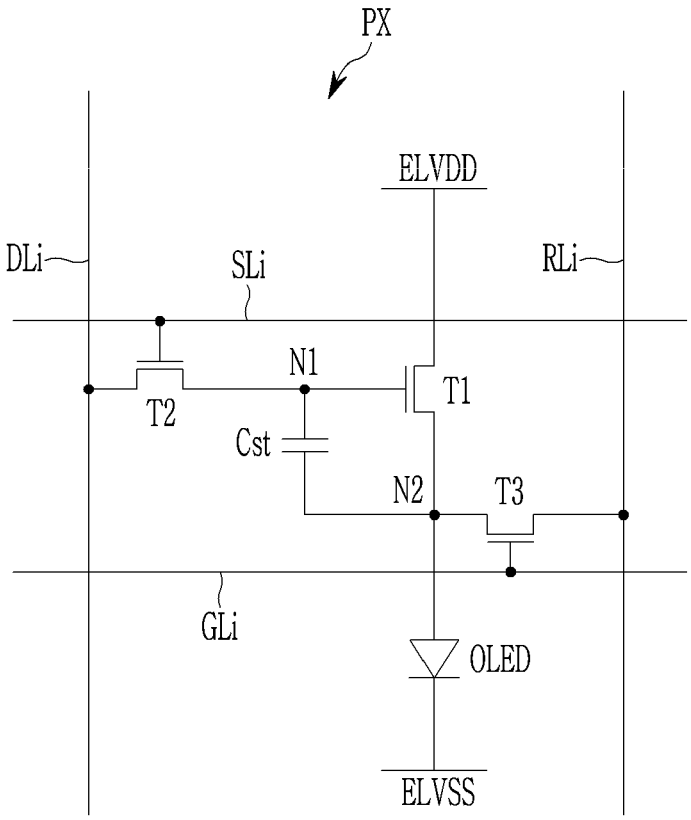
FIG. 2 shows a circuit diagram of a pixel of the display device shown in FIG. 1 according to an embodiment.

FIG. 2 shows a circuit diagram of a pixel of the display device 10 shown in FIG. 1 according to an embodiment.

The pixel PX may include an organic light emitting diode (OLED), a first transistor T1, a second transistor T2, a storage capacitor Cst, and a third transistor T3.

The organic light emitting diode (OLED) may be connected between the second node N2 and the second power voltage (ELVSS). The organic light emitting diode (OLED) may emit light based on the driving current transmitted through the first transistor T1.

The first transistor T1 is connected between the first power voltage (ELVDD) and the second node N2, and includes a gate connected to the first node N1. The second node N2 may correspond to the anode of the organic light emitting diode (OLED). The first transistor T1 may transmit the driving current to the organic light emitting diode (OLED) in response to the voltage at the first node N1.

The second transistor T2 is connected between the data line (DLj) and the first node N1, and includes a gate connected to the corresponding scan line (SLi). The second transistor T2 may supply the data voltage or the sensing reference voltage applied to the data line (DLj) to the first node N1 in response to the scan signal transmitted to the scan line (SLi).

The storage capacitor Cst is connected between the second node N2 and the first node N1. The storage capacitor Cst may temporarily store the voltage supplied through the second transistor T2.

The third transistor T3 is connected between a lead out line (RLj) (among RL1 to RLm shown in FIG. 1) and the second node N2, and may include a gate connected to the corresponding gate line (GLi). The third transistor T3 may apply the initialization voltage to the second node N2 or may supply the voltage at the second node N2 to the lead out line (RLj) in response to the gate signal transmitted through the gate line (GLi). The voltage at the second node N2 may include threshold voltage information of the first transistor T1.

The lead out line (RLj) is connected to the sensing unit 122, and the sensing signal corresponding to the threshold voltage of the first transistor T1 is supplied to the sensing unit 122.

An operation for sensing degradation information of the organic light emitting diode (OLED) may be as the following. When the third transistor T3 is turned on by the gate signal transmitted through the gate line (GLi), a predetermined current supplied from the sensing unit 122 passes through the third transistor T3 and the organic light emitting diode (OLED) and is supplied to the wire of the second power voltage (ELVSS). A voltage is applied to the organic light emitting diode (OLED) corresponding to the predetermined current, and the sensing unit 122 detects a voltage value of the voltage as degradation information of the organic light emitting diode (OLED).

A process for sensing the degradation information of the organic light emitting diode (OLED) may be performed when a power voltage is supplied to the display device 10.

An operation for sensing the threshold voltage and electron mobility (μ) of the first transistor T1 may be as the following. When the second transistor T2 is turned on by the scan signal transmitted through the scan line (SLi), the first transistor T1 receives a sensing reference voltage applied through the data line (DLj). When the third transistor T3 is turned on by the gate signal transmitted through the gate line (GLi), the current flowing through the first transistor T1 may significantly flow to the sensing unit 122 through the lead out line (RLj). The signal controller 140 may determine a change of the threshold voltage and electron mobility (μ) of the first transistor T1 (caused by degradation) based on the reduced current value.

The transistors T1, T2, and T3 included in the pixel PX may be n-type transistors or p-type transistors. Some of the transistors T1, T2, and T3 included in one pixel PX may be p-type transistors, and others may be n-type transistors. Some of the transistors T1, T2, and T3 included in one pixel PX may be oxide semiconductor transistors (Oxide TFT), and the others may be transistors including a low-temperature polycrystalline silicon (LTPS) semiconductor layer. The transistors T1 and T2 may be oxide semiconductor transistors, and the transistor T3 may be a LTPS transistor. The transistors T1 and T2 may be LTPS transistors, and the transistor T3 may be an oxide semiconductor transistor. The oxide semiconductor layer may include one of oxides based on titanium (Ti), hafnium (Hf), zirconium (Zr), aluminum (Al), tantalum (Ta), germanium (Ge), zinc (Zn), gallium (Ga), tin (Sn), or indium (In), and their complex oxides including a zinc oxide (ZnO), an indium-gallium-zinc oxide (InGaZnO4), an indium-zinc oxide (Zn—In—O), a zinc-tin oxide (Zn—Sn—O), an indium-gallium oxide (In—Ga—O), an indium-tin oxide (In—Sn—O), an indium-zirconium oxide (In—Zr—O), an indium-zirconium-zinc oxide (In—Zr—Zn—O), an indium-zirconium-tin oxide (In—Zr—Sn—O), an indium-zirconium-gallium oxide (In—Zr—Ga—O), an indium-aluminum oxide (In—Al—O), an indium-zinc-aluminum oxide (In—Zn—Al—O), an indium-tin-aluminum oxide (In—Sn—Al—O), an indium-aluminum-gallium oxide (In—Al—Ga—O), an indium-tantalum oxide (In—Ta—O), an indium-tantalum-zinc oxide (In—Ta—Zn—O), an indium-tantalum-tin oxide (In—Ta—Sn—O), an indium-tantalum-gallium oxide (In—Ta—Ga—O), an indium-germanium oxide (In—Ge—O), an indium-germanium-zinc oxide (In—Ge—Zn—O), an indium-germanium-tin oxide (In—Ge—Sn—O), an indium-germanium-gallium oxide (In—Ge—Ga—O), a titanium-indium-zinc oxide (Ti—In—Zn—O), and a hafnium-indium-zinc oxide (Hf—In—Zn—O).

Figure 3:
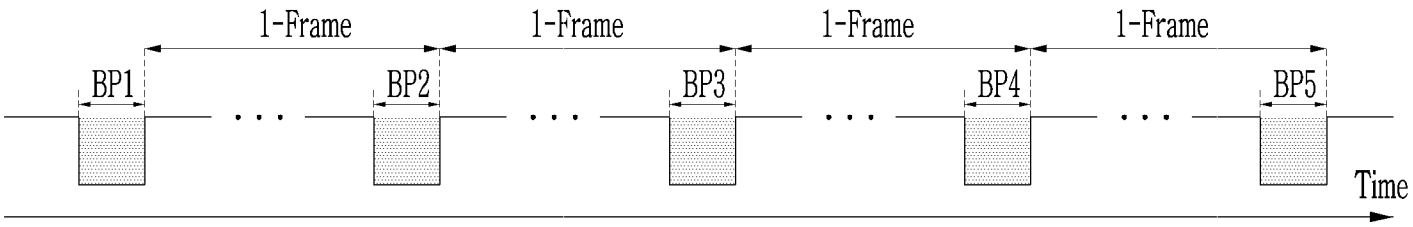
FIG. 3 shows a graph of a period for sensing a pixel in one frame period according to an embodiment.

FIG. 3 shows a graph of a period for sensing a pixel PX in one frame period according to an embodiment.

In one frame period (1-Frame), an operation for sensing a pixel may be performed for vertical blank periods (e.g., BP1, BP2, BP3, BP4, or BP5) and not performed in a period for displaying an image. That is, degradation information on pixels PX may be sensed when the pixels PX emit no light.

At the 60 Hz frame frequency with the 8K resolution, a time for sensing all the pixels PX in the display unit 100 may be 216 seconds, that is, 3.6 minutes. When the data driver 120 is driven by applying a data voltage by two pixels PX (e.g., RB or GG) among the pixels PX grouped by four pixels (e.g., RGBG), the time for sensing all the pixels PX in the display unit 100 may be 432 seconds, that is, 7.2 minutes. Although the pixel is degraded for 7.2 minutes, the degradation may not be sensed, so a sensing error on the pixel degradation may increase. The sensing error may prevent appropriate correction of the image data. As a result, image display quality of the display device 10 may deteriorate.

According to an embodiment, the sensing error on pixel degradation may be minimized through sensing the pixels starting from the pixels that may be prone to degradation, based on ages of the pixels.

Figure 4:
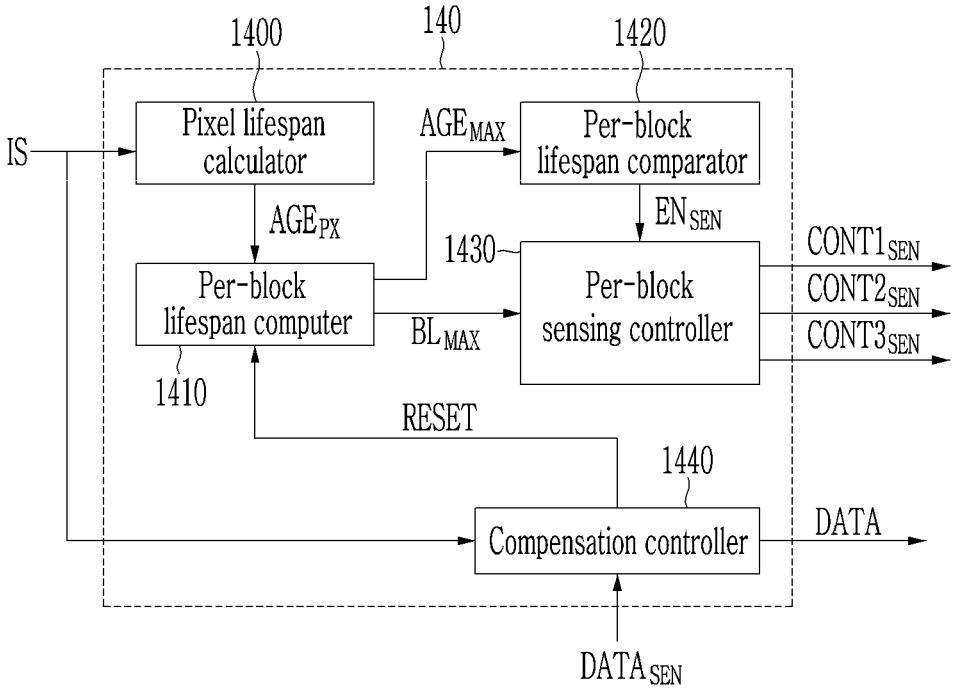
FIG. 4 shows a block diagram of a signal controller of the display device shown in FIG. 1 according to an embodiment.
Figure 5:
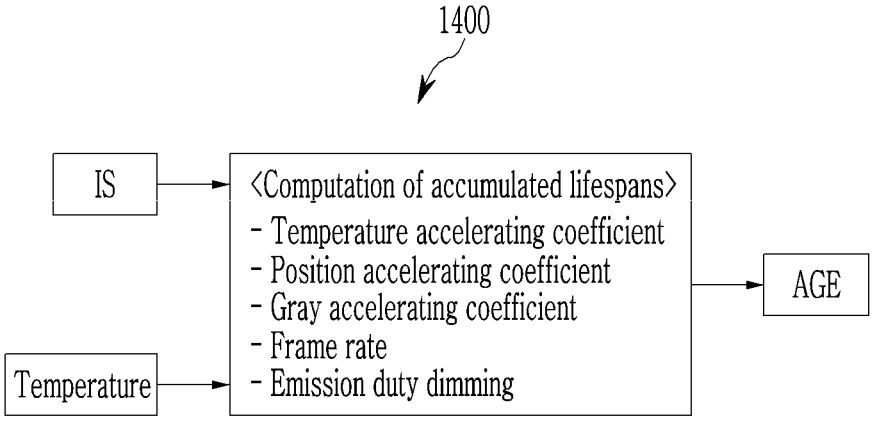
FIG. 5 shows a schematic view of the pixel age calculator shown in FIG. 4 according to an embodiment.
Figure 6:
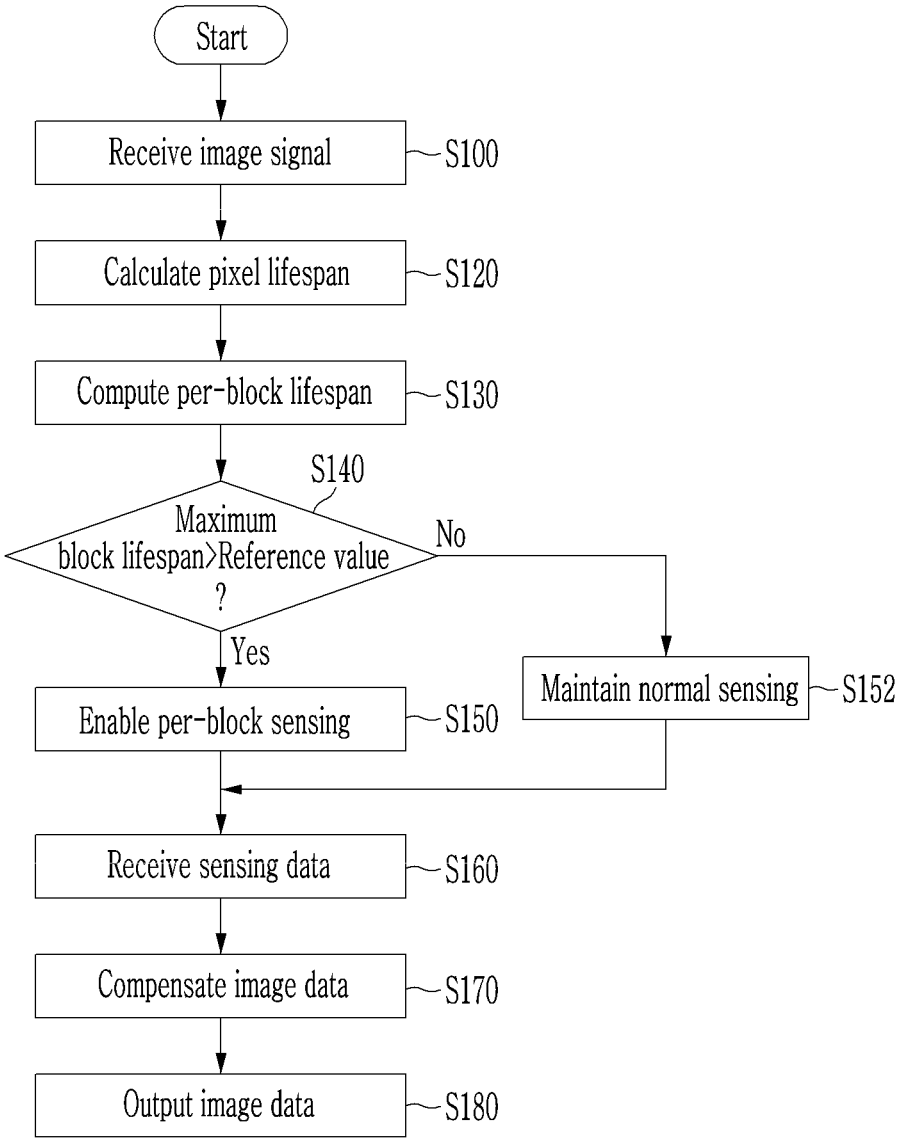
FIG. 6 shows a flowchart of a method for a display device according to an embodiment.
Figure 7:
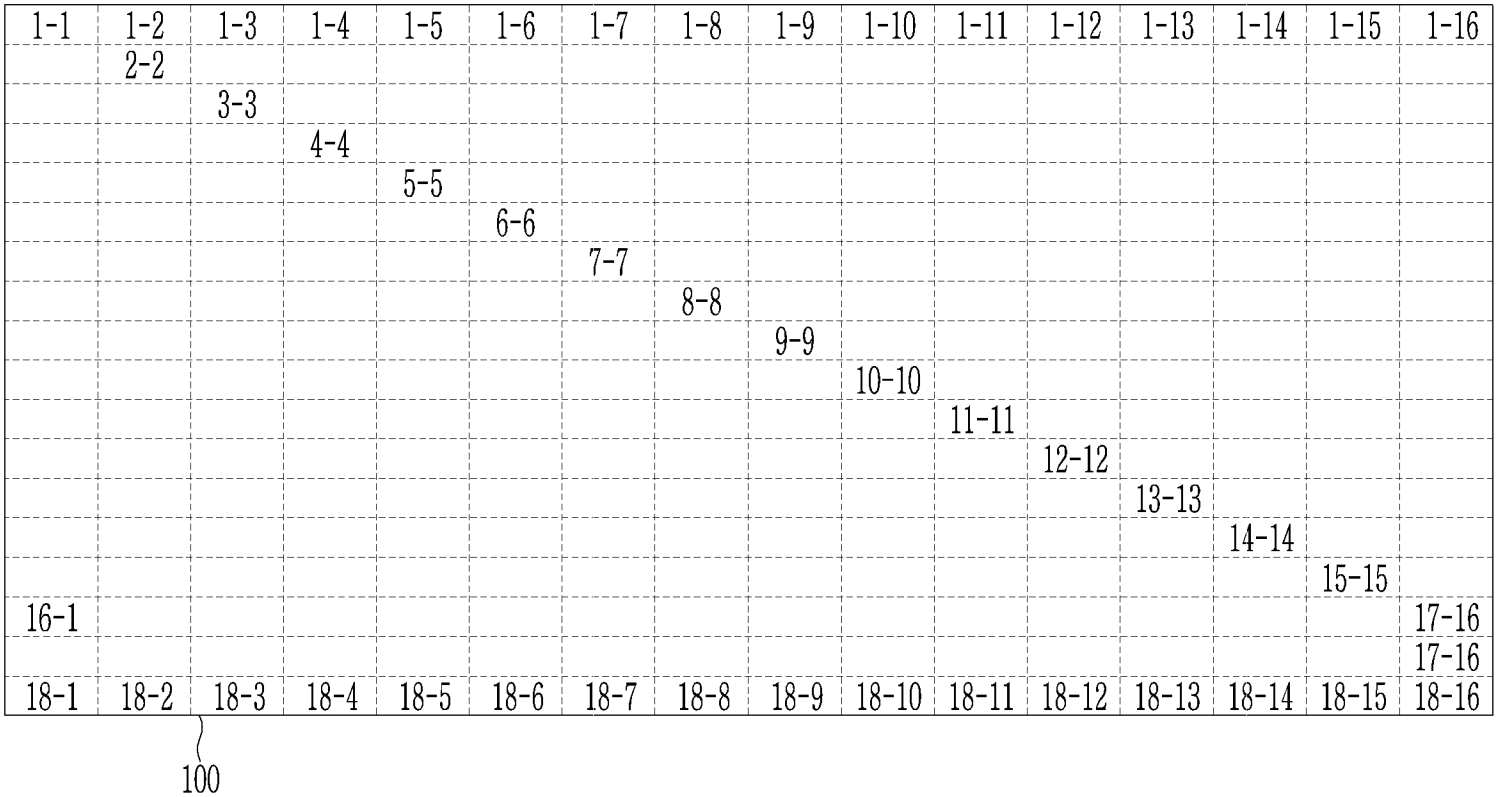
FIG. 7 shows a display unit of a display device according to an embodiment.

FIG. 4 shows a block diagram of the signal controller 140 of the display device 10 shown in FIG. 1 according to an embodiment. FIG. 5 shows a schematic view of a pixel age calculator shown in FIG. 4 according to an embodiment. FIG. 6 shows a flowchart of a method for a display device according to an embodiment. FIG. 7 shows a display unit of a display device according to an embodiment.

As shown in FIG. 4, the signal controller 140 may include a pixel age calculator 1400, a per-block age computer 1410, a per-block age comparator 1420, a per-block sensing controller 1430, and a compensation controller 1440. One or more of elements 1400, 1410, 1420, 1430, and 1440 may be separate from the signal controller 140.

Referring to FIG. 4 and FIG. 6, the signal controller 140 receives an image signal (IS) (in the step S100).

The pixel age calculator 1400 calculates a pixel age based on the image signal (IS) (in the step S120). Referring to FIG. 5, the pixel age calculator 1400 may receive the image signal (IS) and temperature information on the display unit 100, and may calculate a pixel age corresponding to ages of electronic parts (such as the first transistor T1) included in the pixel PX, according to a age calculate algorithm, based on the image signal (IS) and the temperature information. The age calculate algorithm may calculate pixel age data for pixels PX using at least one of a temperature accelerating coefficient, a grayscale accelerating coefficient, a frame rate, and emission duty dimming based on the image signal (IS) and the temperature information. The calculated pixel age data for pixels PX may be stored in a memory and may be updated periodically.

As shown in FIG. 7, the display unit 100 may be divided into blocks, e.g., blocks 1-1 to 18-16 including blocks 1-1, 1-2, 1-3, 1-4, 1-5, 1-6, 1-7, 1-8, 1-9, 1-10, 1-11, 1-12, 1-13, 1-14, 1-15, 1-16, 2-2, 3-3, 4-4, 5-5, 6-6, 7-7, 8-8, 9-9, 10-10, 11-11, 12-12, 13-13, 14-14, 15-15, 16-1, 16-16, 17-16, 18-1, 18-2, 18-3, 18-4, 18-5, 18-6, 18-7, 18-8, 18-9, 18-10, 18-11, 18-12, 18-13, 18-14, 18-15, and 18-16. Each block may include at least two pixels PX.

The per-block age computer 1410 computes a representative age value for blocks using the ages of the pixels included in the blocks (in the step S130). The per-block age computer 1410 may compute an average value of the ages of the pixels PX included in a block as a representative age value for the block. The per-block age computer 1410 may determine a maximum value ($AGE_{MAX}$) among the representative age values for the blocks, may transmit the maximum value ($AGE_{MAX}$) to the per-block age comparator 1420, and may provide block information ($BL_{MAX}$) on the corresponding blocks to the per-block sensing controller 1430.

The per-block age comparator 1420 compares the maximum value ($AGE_{MAX}$) with a reference value (in the step S140). The reference value may increase over time, may increase along with the number of displayed frames, or may be constant.

The per-block age comparator 1420 outputs a sensing enable signal ($EN_{SEN}$) to the per-block sensing controller 1430 when the maximum value ($AGE_{MAX}$) is greater than the reference value (in the step S150).

The per-block age comparator 1420 maintains a normal sensing mode for the sensing unit 122 to sequentially sense all the pixels in the vertical blank period when the maximum value ($AGE_{MAX}$) is equal to or less than the reference value (in the step S152).

In the normal sensing mode, the pixels may be sensed in a predetermined order for the vertical blank periods in the continuous frame period. For example, in a predetermined order, in a pixel column, the eight pixels respectively connected to the first scan line to the eighth scan line are sequentially sensed in the vertical blank period of the first image frame, and the eight pixels respectively connected to the ninth scan line to the sixteenth scan line are sequentially sensed in the vertical blank period of the second image frame that immediately follows the first frame period. The first to eighth scan lines (which are for applying scan signals for the vertical blank period of the first image frame) are arranged near the ninth to sixteenth scan lines (which are for applying scan signals for the vertical blank period of the second image frame).

The per-block sensing controller 1430 generates a control signal ($CONT1_{SEN}$) for driving the data driver 120, a control signal ($CONT2_{SEN}$) for driving the scan driver 110, and a control signal ($CONT3_{SEN}$) for driving the gate driver 130 The per-block sensing controller 1430 outputs the control signals according to the sensing enable signal ($EN_{SEN}$).

The data driver 120 may apply sensing reference voltages to the data lines that are connected to the blocks specified by the control signal $CONT1_{SEN}$. The scan driver 110 may sequentially apply scan signals to the scan lines that are connected to the blocks specified by the control signal $CONT2_{SEN}$. The gate driver 130 may sequentially apply gate signals to the gate lines that are connected to the blocks specified by the control signal $CONT3_{SEN}$.

The pixels of the specified blocks may be sensed, without following a predetermined order, for the vertical blank periods in the consecutive frame periods. When/after scan signals are sequentially applied to eight pixels (or eight pixel rows) respectively connected to the first to eighth scan lines for the vertical blank period of the first image frame, scan signals may be sequentially applied to the pixels of the specified blocks, for example, blocks connected to the thirty-third to fortieth scan lines, not the ninth to sixteenth scan lines, for the vertical blank period of the second image frame that follows the first image frame. The two scan line sets (e.g., the first to eighth scan lines and the thirty-third to fortieth scan lines) for receiving the scan signals for the vertical blank periods of the two consecutive image frames may be separated from each other with at least one intervening scan line (e.g., the ninth to thirty-second scan lines).

When the (maximum) pixel age is less than or equal to a reference value, the display device 10 is in a normal sensing mode for sensing degradation information of pixels PX sequentially. When the pixel age is (equal to or) greater than the reference value, the display device 10 may sense degradation information of the pixel PXs having an age that is equal to or greater than a reference value.

The degradation information of the pixel PXs includes at least one of a threshold voltage of the first transistor T1, electron mobility (μ) information of the first transistor T1, and degradation information of the organic light emitting diode (OLED).

For example, a threshold voltage and an electron mobility (μ) level of the first transistor T1 may be sensed. In the normal sensing mode, for a pixel column, instances of the scan signal and instances of the gate signal are sequentially applied to the eight pixels respectively connected to the first to eighth scan lines for the vertical blank period of the first image frame, so the display device 10 may measure the threshold voltage and electron mobility (μ) of the eight first transistors T1 of the eight pixels respectively connected to the first to eighth scan lines, and instances of the scan signal and instances of the gate signal are sequentially applied to the eight pixels respectively connected to the ninth to sixteenth scan lines for the vertical blank period of the second image frame that immediately follows the first image frame, so the display device 10 may measure the threshold voltage and electron mobility (μ) of the eight first transistors T1 of the eight pixels respectively connected to the ninth to sixteenth scan lines. When the (maximum) pixel age calculated corresponding to the second image frame period is greater than a reference value, instances of the scan signal and instances of the gate signal are sequentially applied to the pixels having pixel ages that are (equal to or) greater than the reference value, for example, the eight pixels connected not to the ninth to sixteenth scan lines but to the thirty-third to fortieth scan lines, for the vertical blank period of the second image frame, so the display device 10 may measure the threshold voltage and electron mobility (μ) of the eight first transistors T1 of the eight pixels respectively connected to the thirty-third to fortieth scan lines.

Therefore, the sensing unit 122 may sense the threshold voltage and electron mobility of the first transistors T1 included in the pixels PX positioned of the specific blocks.

The compensation controller 1440 receives sensing data ($DATA_{SEN}$) of the pixels sensed by the sensing unit 122 (in the step S160).

The compensation controller 1440 compensates/adjusts the data signal (DATA) by applying the threshold voltage and electron mobility information of the first transistor T1 (in the step S170) and outputs the adjusted data signal (DATA) (in the step S180). The compensation controller 1440 may adjust the data signal (DATA), generated according to the image signal (IS), using the threshold voltage and electron mobility information of the first transistor T1 included in the pixels PX of the corresponding block. The compensation controller 1440 may output the adjusted data signal DATA.

The compensation controller 1440 may determine a gray compensation value corresponding to the sensing data ($DATA_{SEN}$) and the input image signal (IS). The compensation controller 1440 may generate an adjusted data signal (DATA) by applying the gray compensation value to the input image signal (IS). The compensation controller 1440 may determine the gray compensation value for each gray corresponding to the grays displayed by the pixel PX. The compensation controller 1440 may determine the gray compensation value using a lookup table method or a function algorithm method. Emission efficiencies are different for different grays, and degradation amounts are different for different grays, so different compensation values may be applied according to the displayed grays. The compensation controller 1440 may determine an optimal compensation value by considering the (accumulated) degradation amount and the gray to be displayed in the present frame.

The compensation controller 1440 outputs a reset signal (RESET), for resetting the pixel age(s) of the pixel(s) included in the compensated block, to the per-block age computer 1410.

The signal controller 140 may sense pixels when the pixel ages calculated/determined for the pixels are greater than a reference value.

Figure 8:
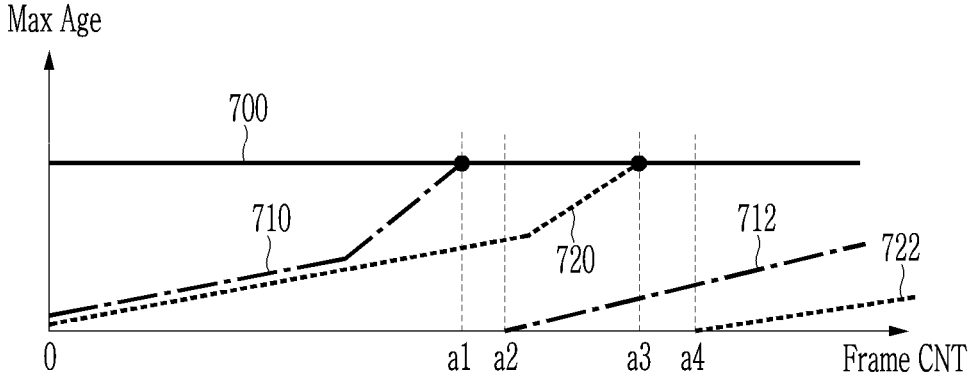
FIG. 8 shows a graph of a method for sensing a pixel according to an embodiment.
Figure 9:
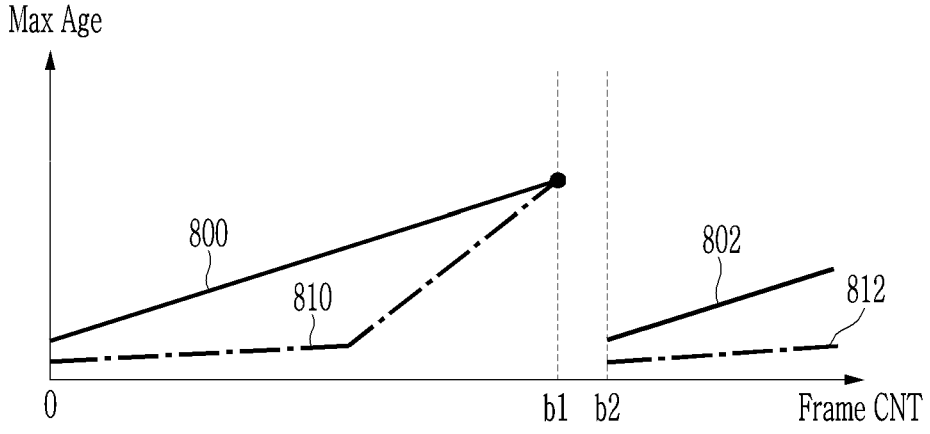
FIG. 9 shows a graph of a method for sensing a pixel according to an embodiment.
Figure 10:
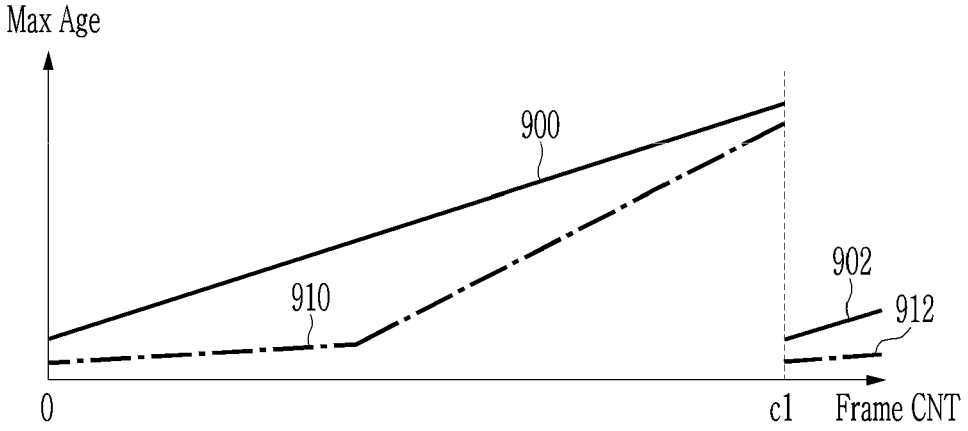
FIG. 10 shows a graph of a method for sensing a pixel according to an embodiment.

Each of FIG. 8, FIG. 9, and FIG. 10 shows a graph of a method for sensing a pixel according to an embodiment.

The per-block age comparator 1420 may compare the reference value with the maximum value ($AGE_{MAX}$). The reference value may increase over time, may increase along with the number of displayed frames, or may be constant.

Referring to FIG. 8, the age reference value 700 is constant when the number of frames displayed to the display unit 100 is accumulated. The per-block ages 710 and 720 calculated by the pixel age calculator 1400 and the per-block age computer 1410 increase as the number of frames is accumulated.

Until the frame a1, the sensing unit 122 may sequentially sense all the pixels for the vertical blank period.

In the frame a1, when the age 710 of the block 1-1 of FIG. 7 reaches the age reference value 700, the per-block age comparator 1420 outputs a sensing enable signal ($EN_{SEN}$) to the per-block sensing controller 1430, so the sensing unit 122 may sense degradation information of the pixel PXs included in the block 1-1, e.g., the threshold voltages and electron mobility levels of the first transistors T1 of the pixels PXs. In the frame a2, when the compensation controller 1440 compensates the data signal (DATA) according to the sensed degradation information, the compensation controller 1440 may output a signal (RESET), for resetting the (representative) pixel age of the compensated block 1-1, to the per-block age computer 1410, and the per-block age computer 1410 may reset the age 712 of the block 1-1.

Until the frame a3 after the frame a2, the sensing unit 122 may sequentially sense the pixels excluding the block 1-1 for the vertical blank period.

In a like manner, in the frame a3, when the age 720 of the block 16-1 shown in FIG. 7 reaches the age reference value 700, the per-block age comparator 1420 outputs a sensing enable signal ($EN_{SEN}$) to the per-block sensing controller 1430, so the sensing unit 122 may sense degradation information of the pixels PX included in the block 16-1, e.g., the threshold voltage and electron mobility values of the first transistors T1 of the pixels PX.

In the frame a4, when the compensation controller 1440 compensates the data signal (DATA) according to the sensed degradation information, the compensation controller 1440 may output a signal (RESET), for resetting the (representative) pixel age of the compensated block 16-1, to the per-block age computer 1410, and the per-block age computer 1410 may reset the age 722 of the block 16-1.

After the frame a4, the sensing unit 122 may sequentially sense the pixels except the block 16-1 for the vertical blank period.

Referring to FIG. 9, the age reference value 700 increases as the number of frames displayed by the display unit 100 increases. The per-block age 810 calculated by the pixel age calculator 1400 and the per-block age computer 1410 increases as the number of frames increases.

Before the frame b1, the sensing unit 122 may sequentially sense all the pixels for the vertical blank period.

In the frame b1, when the age 810 of the block 1-1 of FIG. 7 reaches the age reference value 800, the per-block age comparator 1420 outputs a sensing enable signal ($EN_{SEN}$) to the per-block sensing controller 1430, so the sensing unit 122 may sense degradation information on the pixels PX included in the block 1-1, e.g., the threshold voltages and electron mobility levels of the first transistors T1 of the pixels PX.

In the frame b2, when the compensation controller 1440 compensates the data signal (DATA) according to the sensed degradation information, the compensation controller 1440 may output a signal (RESET), for resetting the (representative) pixel age of the compensated block 1-1, to the per-block age computer 1410, and the per-block age computer 1410 may reset the age 812 of the block 1-1 and the age reference value 802.

After the frame b2, the sensing unit 122 may sequentially sense the pixels excluding the block 1-1 for the vertical blank period.

As shown in FIG. 10, the age reference value 900 increases as the number of frames displayed by the display min 100 increases. The per-block age 910 calculated by the pixel age calculator 1400 and the per-block age computer 1410 increases as the number of frames increases.

As the age 910 of all the blocks has not reached the age reference value 900 when the number of frames reaches a predetermined number c1, the per-block age computer 1410 may reset the age 912 of the blocks and the age reference value 902 in the c1-th frame.

In this case, the sensing unit 122 may sequentially sense all the pixels for the vertical blank period.

According to embodiments, sensing of pixel degradation may start from the pixels with relatively older ages (i.e., pixels that have emitted light for relatively more frames), and data signals may be adjusted to compensate for pixel degradation. Advantageously, pixel degradation may be timely compensated for, power consumption for sensing of pixel degradation may be minimized, and satisfactory image quality may be attained.

While example embodiments have been described, practical embodiments are not limited to the described embodiments. Practical embodiments cover various modifications and equivalent arrangements within the scope of the appended claims.

What is claimed is:

1. A display device comprising:

a scan driver for transmitting scan signals to scan lines;

a gate driver for transmitting gate signals to gate lines;

a data driver for transmitting data signals to data lines;

lead lines;

a sensing unit for receiving currents from the lead lines;

a display unit including pixels electrically connected to the scan lines, the gate lines, the data lines, and the lead lines; and a signal controller for controlling at least one of the scan driver, the gate driver, the data driver, and the sensing unit to sense deterioration information of one or more of the pixels and for resetting at least one age associated with a pixel group of the pixels, wherein a first scan line among the scan lines is for applying a scan signal for a vertical blank period of a first image frame, a second scan line among the scan lines is for applying a scan signal for a vertical blank period of a second image frame, the second image frame immediately follows the first image frame, and at least one intervening scan line among the scan lines is positioned between the first scan line and the second scan line, wherein the pixels are divided into pixel groups, and the signal controller selects the first pixel set as a first pixel group when an average age of the pixels included in the first pixel set is greater than a reference value, and wherein, when the sensing unit senses deterioration information of the pixels included in the first pixel group, the signal controller resets the average age of the pixels included in the first pixel group.

2. The display device of claim 1, wherein each of the pixels includes:

an organic light emitting diode;

a first transistor electrically connected to an anode of the organic light emitting diode and transmitting a driving current;

a storage capacitor electrically connected to a gate of the first transistor;

a second transistor electrically connected to a gate line and a scan line and transmitting a data voltage corresponding to a data signal to the storage capacitor; and a third transistor electrically connected between a lead line and the anode and including a gate electrically connected to the gate line.

3. The display device of claim 2, wherein the second transistor is turned on by a scan signal and transmits a sensing reference voltage received from a data line to the storage capacitor for a vertical blank period of a first image frame.

4. The display device of claim 3, wherein the third transistor is turned on by a gate signal and transmits a current received from the first transistor to the sensing unit according to a sensing reference voltage.

5. The display device of claim 2, wherein the deterioration information includes threshold voltage and electron mobility information of the first transistor or first transistors of the one or more of the pixels.

6. The display device of claim 1, wherein a first gate line is for applying a gate signal for the vertical blank period of the first image frame, a second gate line is for applying a gate signal for the vertical blank period of the second image frame, and at least one intervening gate line is positioned between the first gate line and the second gate line.

7. A display device comprising:

a display unit including pixels;

a signal controller for selecting a first pixel set from the pixels according to ages of the pixels determined based on an image signal and for resetting at least one age associated with the first pixel set; and a sensing unit electrically connected to each of the display unit and the signal controller for sensing deterioration information of one or more pixels included in the first pixel set for a vertical blank period in which the display unit displays no image, wherein the pixels are divided into pixel groups, and the signal controller selects the first pixel set as a first pixel group when an average age of the pixels included in the first pixel set is greater than a reference value, and wherein, when the sensing unit senses deterioration information of the pixels included in the first pixel group, the signal controller resets the average age of the pixels included in the first pixel group.

8. The display device of claim 7, wherein the pixels are divided into pixel groups, the signal controller selects the first pixel set as a first pixel group, and each the pixels included in the first pixel group includes:

an organic light emitting diode;

a first transistor electrically connected to an anode of the organic light emitting diode; and a storage capacitor electrically connected to a gate of the first transistor, and the deterioration information includes a threshold voltage of the first transistor.

9. The display device of claim 8, wherein each of the pixels included in the first pixel group further includes a second transistor electrically connected to the anode and transmitting a current flowing from the first transistor to the sensing unit, and the sensing unit senses the current as part of the deterioration information.

10. The display device of claim 7, wherein each of the average age and the reference value increases according to a number of image frames displayed by the display unit.

11. The display device of claim 7, wherein the average age increases according to a number of image frames displayed by the display unit, and the reference value is constant when the average age increases.

12. The display device of claim 7, wherein when the average age of the pixels included in the first pixel group is equal to or less than the reference value, the signal controller controls the sensing unit to sequentially sense deterioration information of the pixels of the display unit.

13. The display device of claim 7, wherein the sensing unit senses the deterioration information within the vertical blank period in which the first pixel set emits no light in one image frame period according to the image signal.

14. The display device of claim 7, further comprising a data driver electrically connected to the signal controller for receiving an image data signal from the signal controller and applying a data voltage to the pixels, wherein the signal controller determines a grayscale compensation value according to the deterioration information and the image signal, and the signal controller applies the grayscale compensation value to the image signal to generate the image data signal.

15. The display device of claim 7, wherein the signal controller controls the sensing unit to sense deterioration information of a first pixel among the pixels of the display unit when an age of the first pixel is greater than a reference value.

16. A method for driving a display device, the display device including a display unit, the method comprising:

receiving an image signal;

determining ages of pixels included in the display unit based on the image signal;

selecting a first pixel set from the pixels according to the ages of the pixels;

sensing, using a sensing unit that is electrically connected to the display unit, deterioration information of one or more pixels included in the first pixel set;

resetting at least one age associated with the first pixel set;

dividing the pixels into pixel groups;

comparing an average age of the pixels included in each of the pixel groups with a reference value;

selecting the first pixel set as a pixel group when the average age of the pixels included in the first pixel set exceeds the reference value, and when the deterioration information of the pixels included in the first pixel group is sensed, resetting the average age of the pixels included in the first pixel group.

17. The method of claim 16, wherein the average age of the pixels included in each of the pixel groups and the reference value increase according to a number of image frames displayed by the display unit.

18. The method of claim 16, wherein the average age of the pixels included in each of the pixel groups increases according to a number of image frames displayed by the display unit, and the reference value is constant when the number of image frames increases.

19. The method of claim 16, further comprising:

when the average age of the pixels included in a first pixel group is equal to or less than the reference value, controlling the sensing unit to sequentially sense deterioration information of the pixels included in the display unit.

20. The method of claim 16, comprising:

dividing the pixels into pixel groups; and selecting, using the signal controller the first pixel set as a first pixel group, wherein each of the pixels included in the first pixel group includes:

an organic light emitting diode, a first transistor electrically connected to an anode of the organic light emitting diode, and a storage capacitor electrically connected to a gate of the first transistor, and the deterioration information includes a threshold voltage of the first transistor.

21. The method of claim 16, comprising:

dividing the pixels into pixel groups; and selecting, using the signal controller the first pixel set as a first pixel group, wherein the sensing of the deterioration information of the pixels included in the first pixel group is performed within a vertical blank period in which the pixels included in the first pixel group emit no light according to the image signal.

* * * * *